United States Patent [19]

Fatton

[11] 4,231,090

[45] Oct. 28, 1980

[54] ELECTRONIC GAME OF ADROITNESS INCORPORATED IN AN ELECTRONIC WATCH

[75] Inventor: Jean-Claude Fatton, Le Landeron, Switzerland

[73] Assignee: Ebauches Electroniques SA, Marin, Switzerland

[21] Appl. No.: 843,570

[22] Filed: Oct. 19, 1977

[30] Foreign Application Priority Data

Nov. 5, 1976 [CH] Switzerland ..... 13958/76

[51] Int. Cl.[2] ..... G04C 3/00; A63B 7/00; G08B 23/00

[52] U.S. Cl. ..... 364/411; 368/10; 235/92 T; 235/92 GA; 273/138 A; 340/323; 364/705

[58] Field of Search ..... 58/2, 23 R, 23 A, 23 BA, 58/23 AC, 23 C, 23 D, 23 TF, 23 V, 39.5, 50 R, 50 A, 74, 106, 145 R, 145 AB, 145 D, 145 E, 145 K, 152 R, 152 A, 152 B, 152 DE, 152 F, 152 G, 152 H, 152 T, 152 L, 152 C, 153; 46/174, 175; 235/92 T, 92 GA; 273/1 T, 138 A, 85 G, 181 H, 237; 324/186; 340/323; 364/705

[56] References Cited

U.S. PATENT DOCUMENTS

| | | | |
|---|---|---|---|
| 3,357,703 | 12/1967 | Hurley | 273/138 A |
| 3,456,152 | 7/1969 | Andersen | 58/50 R |
| 3,526,087 | 9/1970 | Goldfarb | 58/2 |
| 3,638,215 | 1/1972 | Payne | 340/323 R |
| 3,653,026 | 3/1972 | Hurley | 340/323 R |
| 3,803,834 | 4/1974 | Reese | 58/152 R |
| 3,950,935 | 4/1976 | Naito | 58/152 R |

*Primary Examiner*—Edith S. Jackmon
*Attorney, Agent, or Firm*—Imirie and Smiley

[57] ABSTRACT

Electronic watch comprising electronic circuits provided for the measurement and the display of the time which are also partly used in order to provide a sequence of different states of the indication of an additional display circuit, an additional control circuit being controlled by a player in such a way as to interrupt the sequence of different states as a function of the instantaneous state of the additional display and of the adroitness of the player.

5 Claims, 3 Drawing Figures

ELECTRONIC GAME OF ADROITNESS INCORPORATED IN AN ELECTRONIC WATCH

SUMMARY OF THE INVENTION

The present invention relates to an electronic watch wherein means are provided to show elements of a game of adroitness. This watch comprises preferably display means capable to take different states and means in order to stop the indication of the display in a given state. The adroitness of the player is decisive for stopping the indication of the display at the right time and thus to achieve a desired result.

The present invention will be described further, by way of example, by reference to the accompanying drawings in which:

DESCRIPTION OF THE PREFERRED EMBODIMENT

Figure 1:
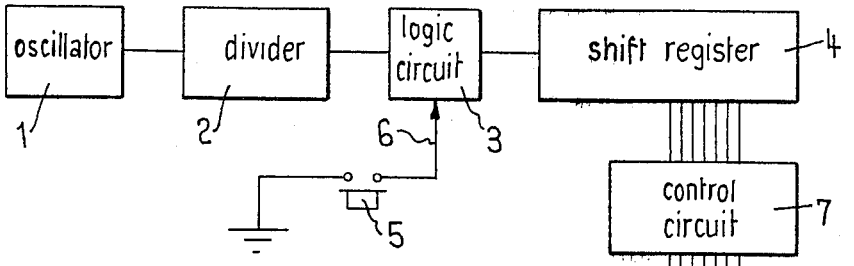
FIG. 1 is a block-diagram of a first embodiment of the invention.

The watch according to FIG. 1 comprises an oscillator 1 and a divider 2. These circuits at least can be part of those provided for the measurement and the display of the time. The pulse signals at the output of the divider 2 goes to a shift register 4 through the logic circuit 3 which is capable of stopping the transmission of these impulses to the shift register when a push-button 5 is actuated in order to close a control circuit 6 of the logic circuit 3. The shift register 4 represents n outputs connected to the corresponding inputs of a control circuit 7 of which the n outputs are each connected to an element in form of a ring of the display. The number of the display elements is n and the ensemble of these concentric elements simulates a target.

Normally, the switch actuated by the push-button 5 is open and the logic circuit 3 transmits the signals at the output of the divider 2 to the shift register 4. The outputs of the shift register 4 are sequentially activated. Also, the outputs of the control circuit 7 and thus the elements of the display are sequentially activated. The repetition frequency of the impulses at the output of the divider 2 is the one that activates sequentially the elements $8_1$ to $8_n$; this frequency is choosen in such a way that the player may observe and recognize the relatively rapid changes of the states of the indication of the display. By pushing the push-button 5, the player can stop the transmission of the impulses at the output of the divider 2 which also stops the variations of the states of the indication of the display. Depending on the adroitness and the experience of the player the latter is capable to stop the indication of the display in such a way that the central element $8_n$ or at least an element of the display which is near of the center of the target is and stays activated. The best result that a player can achieve is to stop the changes of the indications of the display in such a way that the central element $8_n$ stays activated. When the push-button 5 is returned in its rest position, as indicated in FIG. 1, the transmission of the impulses at the output of the divider 2 to the shift register 4 starts again. A new cycle of changes of the states of the indication of the display is beginning and the player can test again his adroitness by exerting a pressure on the push-button 5.

Figure 2:
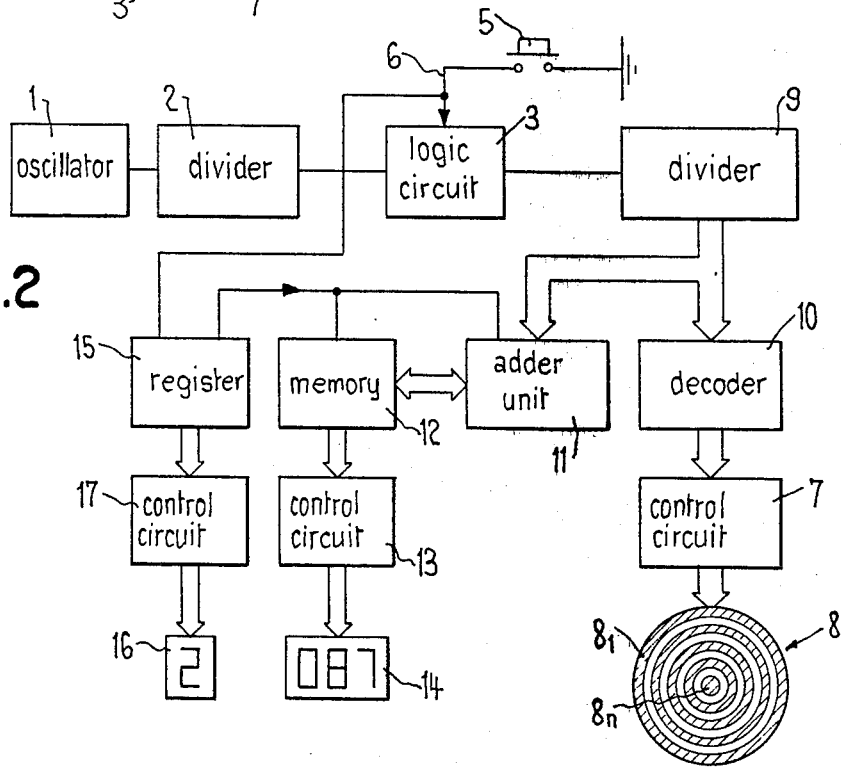
FIG. 2 is a block-diagram of a second embodiment of the invention.

The FIG. 2 shows an embodiment of the invention in which the numerical results of two players are displayed. The circuits 1, 2 and 3 are the same than those of FIG. 1. The impulses at the output of the divider 2 are normally transmitted to a frequency divider by n, 9. The outputs of the divider 9 are in the first place connected to the inputs of a decoder 10. The outputs of this decoder are connected to the inputs of a control circuit 7 which corresponds to that described above and which controls the display elements $8_1$ to $8_n$. The outputs of the divider 9 are also connected to the inputs of an adder unit 11 which is able to perform the addition of several individual results. The unit 11 acts on a memory 12 whose outputs act on a control circuit 13 which controls a numerical display 14. The control circuit 6, controlled by the push-button 5 is connected to a register 15 of choice of the player. The number of the player can be displayed by a display 16 with the help of a control circuit 17. The adder unit 11 and the memory 12 can be controlled by the register 15 in order to calculate and memorize the results associated to each of the players.

In the rest position of the FIG. 2, the impulses at the output of the divider 2 are transmitted to the divider 9 and the states of the indication of the display 8 change in a cyclical manner under the control of the decoder 10 and the control circuit 7. When the first player pushes on the push-button 5, the transmission of the impulses of the divider 2 to the divider 9 is stopped and the indication of the display stops in a determinated state which corresponds to a certain number or numerical result, the nearer of the center of the target of the activated element of the display 8, the better the result. The control pulse produced by the closing of the control circuit 6 is transmitted to the register 15. This register is thus positioned in a first state corresponding to which the display 16 indicates the first player. At the same time the circuits 11 and 12 are activated in order to calculate and memorize the sum total of the results of the first player, the total being indicated on the display 14. The next play belongs to the second player. When the latter pushes on the push-button, the register 15 is positioned in a second state for which the display 16 indicates the number two and the circuits 11 and 12 calculate and memorize the sum total of the results of the second player, total which is indicated by the display 14. It is admitted here that both players play alternatively each one time. However it would be possible to provide a register 15 in such a way that each player plays in succession a certain number of plays, the register 15 staying in the same state for the determinated number of plays of the first player and in a second state for the determinated number of plays of the second player.

Instead of to provide a cyclical change of the indication of the display 8 with a relatively high frequency it would also be possible to provide a change more or less at random at a lower frequency so that the player can stop the indication when the desired state occurs, before the next impuls arrives in order to make the indication change to the next state.

Figure 3:
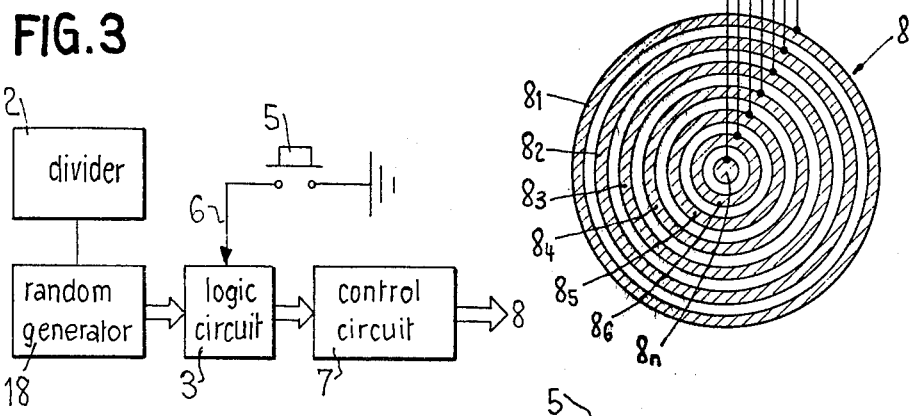
FIG. 3 is a block-diagram of a third embodiment of the invention.

The circuit of FIG. 3 shows an embodiment of the invention in which the ring elements of the ensemble of concentric rings of the target are selected at random but at definite equal intervals of time. The circuits 2, 3, 5, 6, 7 and 8 are the same as those of FIG. 1. The output of a random generator 18 is connected to the logic circuit 3 whose output is directly connected to the control circuit 7. A relatively low frequency signal is delivered by an output of the divider 2 to the random generator 18. At each cycle of the signal from the divider 2, the random generator delivers a binary output whose number of bits is sufficient to cover all of the possible n states necessary to drive the n elements of the display 8. The control of the stop of the indication of the display by the push-button 5 is exactly the same as in the embodiment of FIG. 1.

It is possible to provide other variable display systems. It is possible, for example to display in succession the numbers 0 to 9, the best result being obtain when the player succeeds in stopping the indication of the display on the number 9.

I claim:

1. Electronic game of adroitness incorporated into an electronic watch comprising:

electronic circuits for the measurement of time;

display means capable of displaying a plurality of different states;

electronic means in cooperation with at least part of said time measurement circuits for determining a sequence in time of said different states of said display means and repetitively producing said sequence at a rate such that a player can recognize the changes of said different states, said electronic means comprising:

a first control circuit;

a decoder;

a frequency divider, the outputs of which controlling said display means through said decoder and said first control circuit;

a logic circuit normally transmitting pulses delivered by said electronic time measurement circuit to said frequency divider;

a memory;

a first numeric display;

a calculator unit connected to the output of said frequency divider and cooperating with said memory so as to maintain therein a sum of a plurality of individual results;

a second control circuit through which said memory controls said first numeric display capable of indicating said sum;

a second numeric display;

a third control circuit;

a register for determining the choise of a plurality of players, said register controlling said second numeric display through said third control means to indicate the number of the chosen player; and control means for being actuated by the player of said electronic game for interrupting said sequence of different states according to the instantaneous state of said display means and of the adroitness of the player and which, when actuated, acting on said logic circuit to interrupt the pulses delivered by said electronic time measurement circuits at the output of said logic circuit and according to the chosen player acting at least indirectly through said register upon said memory and said calculator unit.

2. Electronic game according to claim 1 wherein said calculator unit and said memory are capable of totalizing and displaying on said first numeric display the sums of the results of at least two players.

3. Electronic game according to claim 1, wherein said display means includes a number of elements and wherein said electronic means comprise a logic circuit connected to said electronic time measurement circuits for delivering output pulses, a shift register connected to said logic circuit having an output for each element of the display means for sequentially controlling said elements, a control circuit connected to said shift register for controlling the elements of said display means and control means connected to said logic circuit for interrupting the output pulses of said logic circuit when actuated by the player.

4. Electronic game according to claim 3 wherein said display means comprises an ensemble of concentric rings and is capable of displaying in succession each of said rings.

5. Electronic game according to claim 1 wherein said display means is capable of displaying in succession each one of the rings of an ensemble of concentric rings.

* * * * *